United States Patent [19]

Correll, Jr.

[11] Patent Number: 4,676,340

[45] Date of Patent: Jun. 30, 1987

[54] TELESCOPIC BOOM ASSEMBLY HAVING HIGH DIELECTRIC PROPERTIES

[75] Inventor: Charles D. Correll, Jr., Woodbridge, Conn.

[73] Assignee: Pierce-Correll Corporation, Milford, Conn.

[21] Appl. No.: 867,438

[22] Filed: May 28, 1986

[51] Int. Cl.[4] ..... B66F 11/04

[52] U.S. Cl. ..... 182/2; 52/115; 52/118

[58] Field of Search ..... 182/2; 52/115, 118

[56] References Cited

U.S. PATENT DOCUMENTS

| | | | |
|---|---|---|---|
| 3,136,385 | 6/1964 | Eitel | 182/2 |
| 3,233,700 | 2/1966 | Myers | 182/2 |
| 3,301,346 | 1/1967 | Verrell | 182/2 |
| 3,489,243 | 1/1970 | Prescott | 182/2 |
| 3,845,596 | 11/1974 | Veentra | 52/118 |
| 3,947,191 | 3/1976 | Milner | 182/2 |
| 3,958,377 | 5/1976 | Milner | 182/2 |
| 4,258,853 | 3/1981 | Gill | 52/115 |
| 4,327,533 | 5/1982 | Sterner | 52/115 |
| 4,337,601 | 7/1982 | Vaerk | 52/632 |
| 4,434,444 | 8/1984 | Smith | 182/2 |
| 4,478,014 | 10/1984 | Poock | 52/115 |

*Primary Examiner*—Reinaldo P. Machado
*Attorney, Agent, or Firm*—Robert E. Purcell

[57] ABSTRACT

A telescopic boom assembly is disclosed. The assembly includes a plurality of boom members having at least first, second and third boom arms telescopically disposed within each other. The first boom arm is connected to a support base. A mechanism is provided for axially extending the second and third boom arms outwardly from the first boom arm, the third boom arm being constructed from dielectric material and disposed at the distal end of the assembly once the assembly is in a fully extended position. Finally, an end cylinder structure constructed from dielectric material is provided for axially moving the third boom arm relative to the first and second boom arms such that the third boom arm and the end cylinder structure dielectrically insulate the distal end of the third boom arm from the remainder of the boom assembly when the assembly is in an extended condition.

19 Claims, 8 Drawing Figures

TELESCOPIC BOOM ASSEMBLY HAVING HIGH DIELECTRIC PROPERTIES

BACKGROUND OF THE INVENTION

1. Field Of The Invention

The present invention relates generally to boom assembly structures and, more particularly, to telescopic boom assemblies which are mountable to a utility vehicle, construction vehicle or the like. Specifically, the present invention relates to such telescopic boom assemblies which have high dielectric properties.

2. Description Of The Prior Art

Boom assemblies of various types and designs are often employed on cranes and other types of construction or utility vehicles to extend a work tool of some sort mounted on the very end of the boom to positions above and about the vehicle position. A particularly useful example includes utility or construction vehicles having boom assemblies wherein a bucket or other carrier is mounted at the end of the boom assembly. The bucket or carrier is adapted to allow an individual to stand or sit therein for the purpose of working at stations above the ground level of the utility vehicle, such as telephone or utility poles.

Prior boom assembly designs have included pivotal arm arrangements such as disclosed in U.S. Pat. Nos. 3,947,191 and 3,958,377. While these patents disclose nonconductive fiberglass boom constructions, they are limited to pivotal type designs. Other more complicated boom assembly arrangements commonly include telescopic booms whereby a plurality of boom sections are telescopically disposed relative to each other and are extended section by section. Examples of such telescopic booms includes U.S. Pat. Nos. 4,327,533, 4,337,601, 4,478,014, 4,258,853 and 3,845,596. The advantage of such telescoping design is that a greater reach or extension can be obtained. As can be seen from these references, a wide variety of telescopic boom arrangements are known and are available for adaptation to a multitude of purposes. The telescopic boom arrangement is generally preferred in that it is much more compact when in its retracted position on the utility vehicle for traveling purposes.

A common problem with all such telescopic boom assemblies is that if they are to achieve the purpose of providing a substantially extended reach with the operator bucket at the end thereof, they must be constructed from strong materials to provide sufficient strength to carry the axial load as the arms thereof extend outwardly and retract back as well as to carry the depending load at the end of the boom assembly in a fully extended position. Consequently, such boom assemblies have generally been constructed from steel or other similar metal components to provide the necessary structural strength for repeated use. A significant disadvantage with such arrangements is that they are highly conductive thereby placing the worker loacated in the end bucket in jeopardy of receiving electrical shocks in the event the worker is required to work around high voltage items such as utility poles. Therefore, it would be highly desirable to have a telescopic boom assembly with high electrical insulative properties so as to provide a substantial safety factor for a worker positioned at the end of the boom assembly.

SUMMARY OF THE INVENTION

Accordingly, it is an object of the present invention to provide an improved telescopic boom assembly.

It is another object of the present invention to provide a boom assembly having high dielectric properties.

It is a further object of the present invention to provide a telescopic boom assembly which is constructed to provide sufficient structural support while simultaneously providing high insulated value at the distal end of the boom assembly.

To achieve the foregoing and other objects and in accordance with the purpose of the present invention, a telescopic boom assembly is provided. The assembly includes a plurality of boom members having at least first, second and third boom arms telescopically disposed within each other. The first boom arm is connected by appropriate structure to a support base. A mechanism is provided for axially extending the second and third boom arms outwardly from the first boom arm, the third boom arm being constructed from dielectric material and disposed at the distal end of the assembly when the assembly is in a fully extended condition. Finally, an end cylinder arrangement is constructed from dielectric material and is adapted for axially moving the third boom arm relative to the first and second boom arms such that the third boom arm and the end cylinder mechanism dielectrically insulate the distal end of the third boom arm from the remainder of the boom assembly when the assembly is in an extended position.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings in which:

DETAILED DESCRIPTION OF THE PREFERRED EMBODIMENTS

Figure 1:
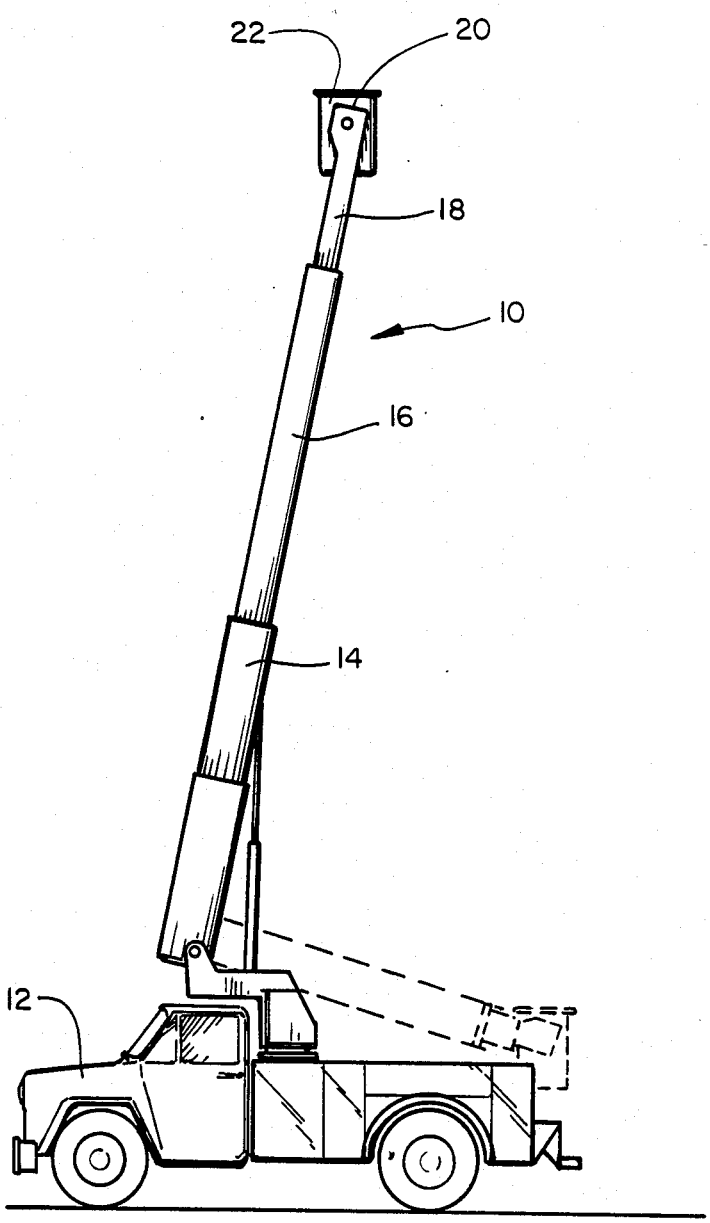
FIG. 1, is a schematic of a utility vehicle having a boom assembly of the present invention mounted thereon.

Referring first to FIG. 1, a boom assembly 10 is mounted to a utility vehicle, construction vehicle, or the like 12. The boom assembly 10 is preferably mounted for 360° rotational movement relative to the vehicle 12 as well as for elevational movement above the horizontal. For further support, a frame (not illustrated) is provided within the vehicle 12 to which the boom assembly 10 is mounted. Furthermore, controls are provided for elevating the boom assembly 10 relative to the vehicle 12 in accordance with any desired manner known to the art.

As can been seen in FIG. 1, the boom assembly 10 preferably includes three boom segments 14, 16 and 18 in telescoping relationship. Thus, as illustrated in greater detail below, when the segments 14–18 are in a retracted position, the segment 18 is disposed within the segment 16, and the segments 16 and 18 are fully disposed within the segment 14. Likewise, when the segments 14–18 are in their fully extended position, as illustrated in FIG. 1, the boom assembly 10 provides a substantial extension of reach upwardly and outwardly relative to the vehicle 12. In preferred form, the distal end 20 of the outermost or fly boom 18 includes an operator or worker carrier bucket 22. The bucket 22 is provided so that an individual (not illustrated) may be positioned therein to achieve work as desired, such as on a utility pole, telephone pole or other similar type of apparatus. Thus, the individual or operator in the bucket 22 may be moved into working position by appropriate rotation, elevation and extension of the boom assembly 10 relative to the vehicle 12. As is typical in such arrangements, controls for operating the boom assembly 10 are provided both at the vehicle 12 as well as at the bucket 22 which are accessible by the worker positioned therein.

Figure 2A:
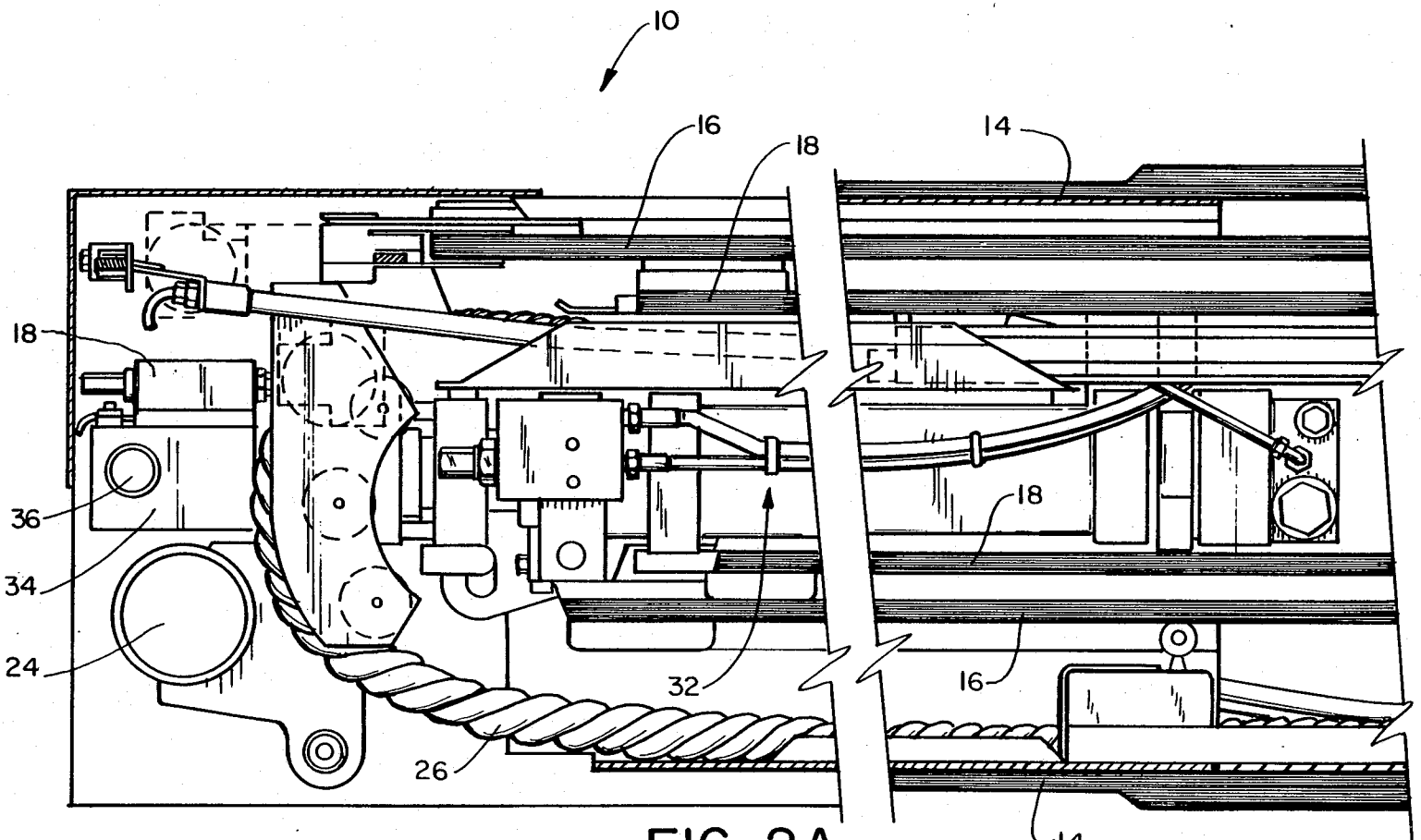
FIGS. 2A and 2B represent is a side view, with some parts in section, of the boom assembly of the present invention in its retracted position.
Figure 2B:
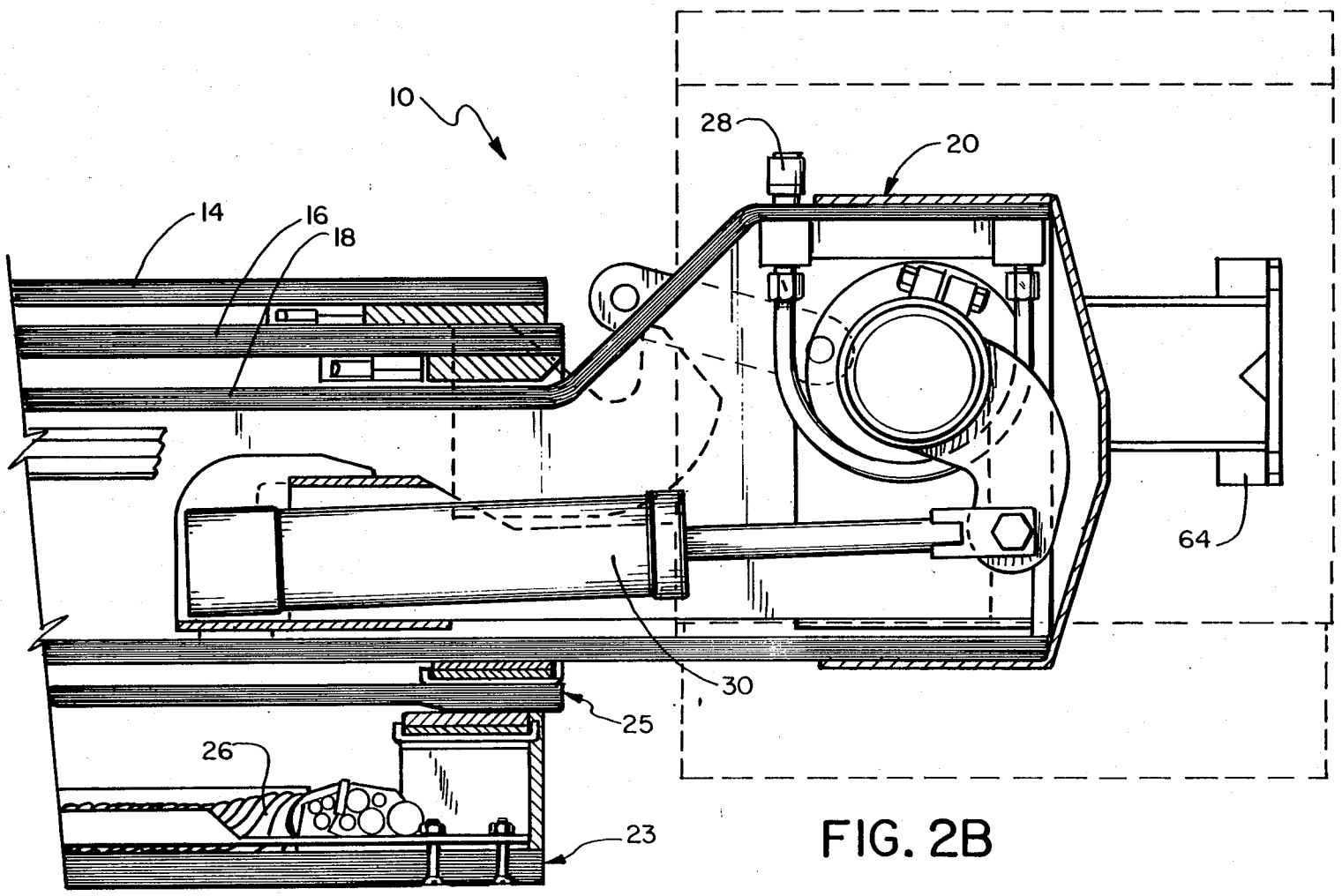

Referring in more detail to FIGS. 2–5, a base or lower boom arm 14 is mounted to the vehicle 12 at the aperture 24. Thus, the boom arm 14 may be pivoted and elevated relative to the vehicle 12. However, arm 14 does remain stationary relative to the vehicle 12 when the boom assembly is extended axially outwardly as described below. As can be seen in FIG. 2, the mid boom section 16 and the fly boom section 18 are telescopically disposed within the lower or base boom section 14. In preferred form, the lower boom section 14 is constructed from steel to provide sufficient structural support for the downward load forces imposed on the boom assembly 10 when the assembly 10 is in a fully extended position.

The mid and fly boom sections 16, 18 are preferably rectangular in cross-section and constructed from a dielectric material such as fiberglass reinforced plastic or the like. While the mid boom section 16 may also be constructed from steel as is preferably the lower boom section 14, the fly boom section 18 must be constructed with the dielectric material for reasons explained in greater detail below. Thus, when the boom assembly 10 is extended, the mid boom section 16 is extended axially outwardly from the end 23 of the lower boom 14 and carries with it the fly boom 18. Once the mid boom 16 is in its fully extended condition from the end 23 of the lower boom 14, then the fly boom 18 extends axially outwardly relative to the mid boom 16 until it projects its maximum extent from the outward end 25 of the mid boom 16. When it is desired to retract the boom assembly 10, the process is reversed by bringing in the fly boom 18 first, then the combined fly boom 18 and mid boom 16 until the two are fully disposed within the lower boom 14.

Operation of the boom assembly 10 is controlled utilizing a hydraulic mechanism. In addition hydraulic lines 26 pass along the length of the boom assembly 10 and terminate in the distal end 20 of the fly boom 18. These hydraulic lines 26 are provided so that hydraulic work tools (not illustrated) may be operated from the coupling 28 at the distal end of the fly boom 18 by an operator positioned within the bucket 22. Thus, the worker is in the bucket 22 has hydraulic pressure readily available to operate any number of desired hydraulic tools at the work station represented by the bucket 22. Hydraulic hoses or lines 26 are also provided for use with an automatic leveling cylinder 30 which permits automatic leveling of the bucket 22 regardless of the position and orientation of the boom assembly 10. The automatic leveling cylinder is well known in the art and will not be described in any greater detail herein. Moreover, while this feature is helpful, it is not essential to the present invention.

Figure 3A:
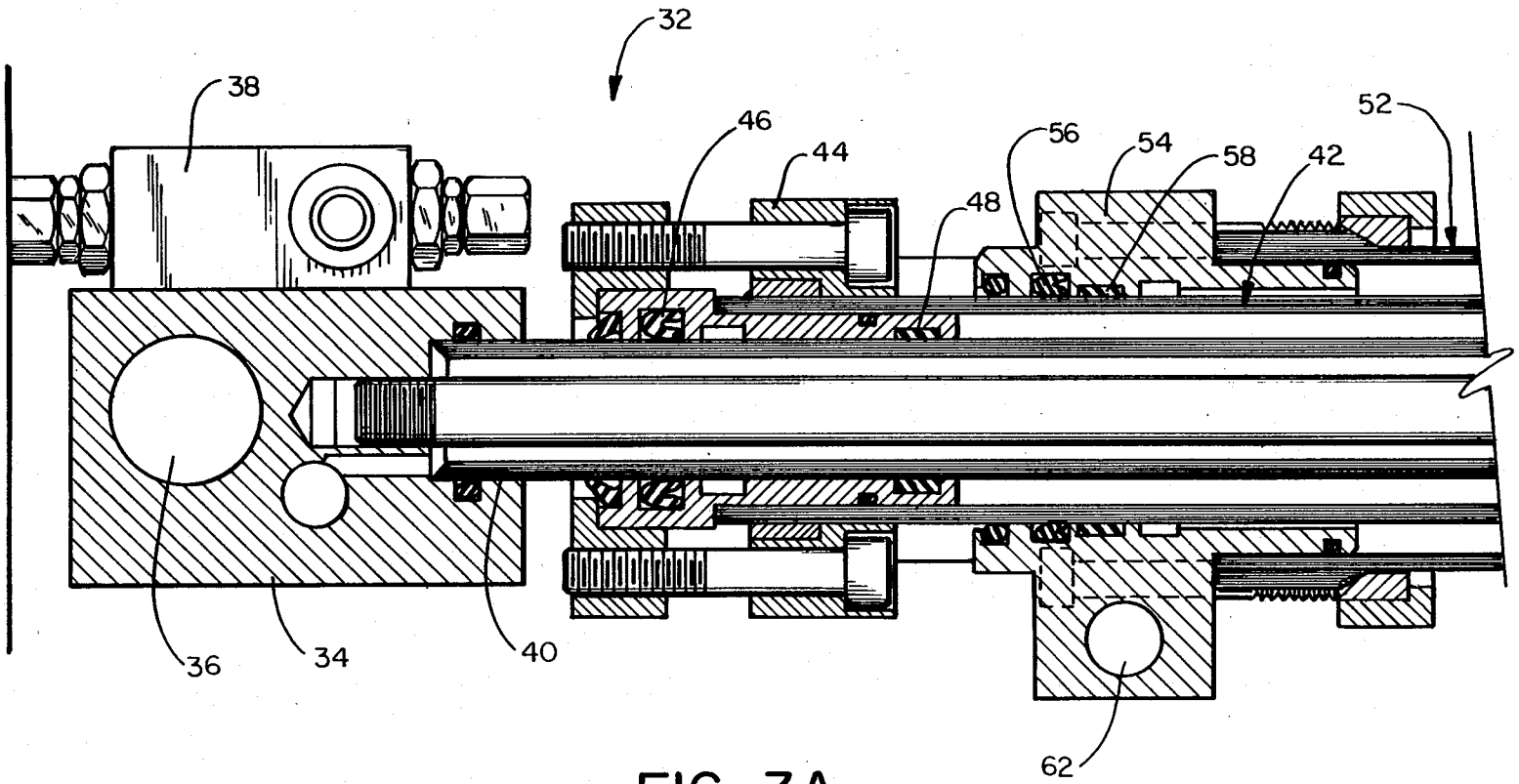
FIGS. 3A and 3B are an enlarged side sectional view of the control cylinder mechanism utlized for extension and retraction of the boom arms and constructed in accordance with the present invention.
Figure 3B:
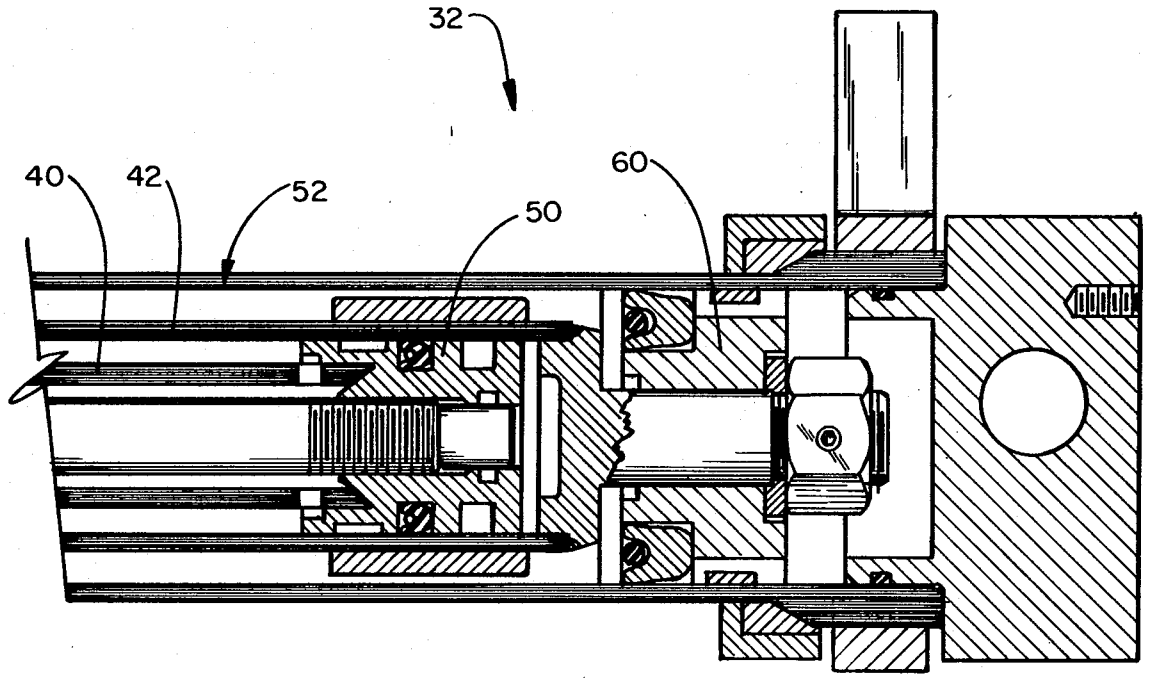
Figure 4:
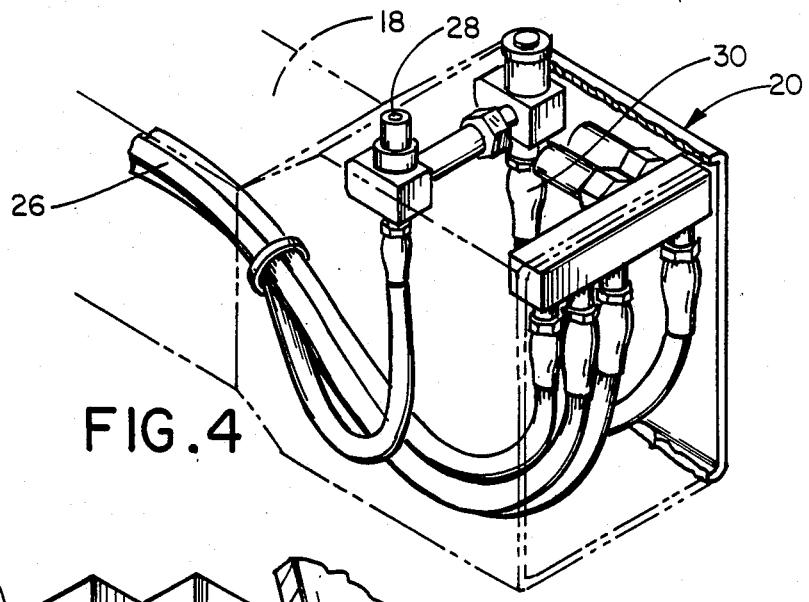
FIG. 4 is a perspective view, with some parts in shadow, of a hydraulic control mechanism disposed at the distal end of the boom assembly of the present invention.
Figure 5:
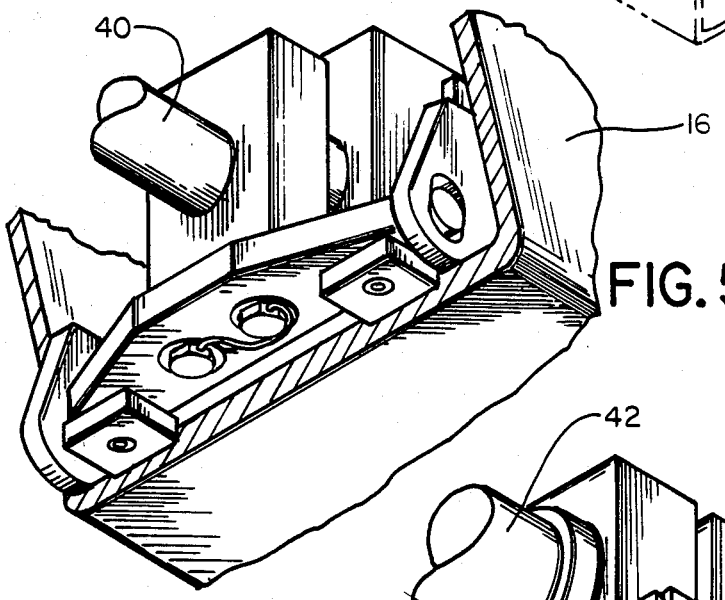
FIG. 5 is an enlarged, perspective fractional view of a portion of the mid boom section of the present invention.
Figure 6:
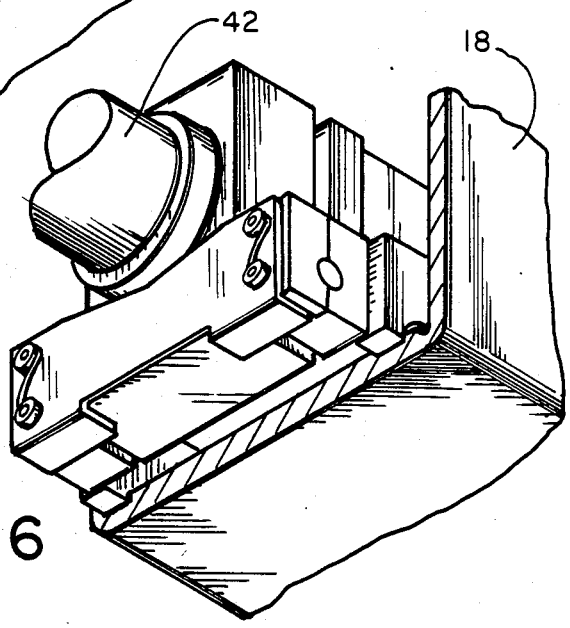
FIG. 6 is an enlarged, perspective fractional view of a portion of the fly boom section of the present invention.

Referring in more detail to FIGS. 2 and 3, an extension control cylinder assembly 32 is provided at the center of the boom sections 14–18. The cylinder arrangement 32 controls the extension and retraction of the boom sections 14–18. In preferred form, the assembly 32 includes a base end member 34 which is secured to the lower end of the lower boom member 14 by connecting pin arrangement 36. A double lock valve 38 is also provided at the end member 34 for the hydraulic control of the assembly 32. A first cylindrically-shaped member 40 is securely mounted to the end member 34 and is preferably in the form of a steel tube. A second cylindrically-shaped member 42 is positioned about the tube 40 and is in the form of a cylinder. The cylinder 42 is mounted on the tube 40 for axial movement thereon. In preferred form, the cylinder 42 is constructed from steel to provide structural strength for the boom assembly 10. The cylinder 42 is connected at its lowermost end to a head assembly 44 which is adapted for axial movement with the cylinder 42 along the tube 40. Seals 46 and wear rings 48 are provided to ensure secure engagement of the head assembly 44 about the rod 40 while providing smooth axial movement along the rod 40.

The rod 40 terminates at its outermost end in a piston member 50 over which the cylinder 42 moves. Thus, the piston 50 operates in conjunction with the head assembly 44 to insure that the cylinder 42 moves smoothly and accurately along the axial length of the rod 40. The head assembly 44 is secured by any appropriate means to the inner surface of the mid boom 16. Thus, as the cylinder 42 moves axially outwardly along the length of the rod 40, this movement pushes the mid boom axially outwardly therewith. Likewise, as the cylinder 42 is retracted by hydraulic controls along the length of the rod 40, such movement pulls the mid boom inwardly within the lower boom 14.

A second or outer cylinder 52 is disposed about the first or inner cylinder 42 and is adapted for axial movement therealong, the cylinder 42 functioning as a center rod for axial movement of the outer cylinder 52. The outer cylinder 52 terminates at its lowermost end in a second head assembly 54. Seals 56 and wear rings 58 are provided to permit firm yet smooth movement of the head assembly 54 along the exterior surface of the cylinder 42. The first or inner cylinder 42 terminates at its outermost end in a second piston assembly 60 over which the outer cylinder 52 moves. Thus, the piston 60 and the head assembly 54 operate together to permit smooth, accurate axial movement of the outer cylinder 52 along the inner cylinder 42. The head assembly 44 is sized and shaped so as to come into an abutting relationship with the head assembly 54 of the outer cylinder 52 when the head assembly 44 and the inner cylinder 42 are moved axially outwardly relative to the rod 40. Thus, outward axial movement of the first cylinder 42 will move the first cylinder 42 and the second cylinder 52 axially outwardly until the full extend of the inner cylinder 42 has been achieved relative to the rod 40. Once this has occurred, separate hydraulic controls activate and move the outer cylinder 52 with the head assembly 54 along the length of the inner cylinder 42 and further extend the boom assembly 10. The head assembly 54 is secured at attachment 62 to the interior surface of the fly boom section of FIG. 2. Thus, axial movement of the outer cylinder 52 will effect identical axial movement of the fly boom section 18.

A block member 64 is attached to the distal end of the fly boom 18. This block member 64 is utilized for attachment to the bucket 22 (see FIG. 1). It is a critical aspect of the present invention that the outer cylinder 52 along with the fly boom arm 18 both be constructed from a high dielectric, non-conductive material such as fiberglass reinforced plastic. In this manner, when the fly boom assembly 18 is in an extended position, the outer cylinder 52 which is connected to the fly boom 18 represents a high dielectric insulating section. Thus, there is no steel continuous reinforcement or support member in the fly boom section of the embodiment of the present invention. Such steel or other similar metal structural supports are highly conductive and this is avoided with the construction of the present invention. Consequently, the fly boom section of the boom assembly 10 electrically insulates the distal end 20 from the vehicle 12. As a result, an individual positioned within the bucket 22 will be electrically insulated from ground or the vehicle 12. In fact, a preferred embodiment of the present invention constructed as described above was tested and provided electrical insulation from the ground up to 100,000 volts at 60 Hz.

As previously indicated, movements of the control assembly 32 are controlled by a hydraulic mechanism. Hydraulic lines (not illustrated) are provided to the cylinders 42 and 52 to permit a transfer scheme whereby the hydraulic cylinder 42 may be extended or retracted and, once extended, the hydraulic fluid then transferred to the second cylinder 52 to extend the same. In retracting the reverse is true. As can be seen from FIG. 4, hydraulic lines 26 lead up to the work station at the bucket 22 so that hydraulic tools may be inserted at the coupling 28 and operated therefrom. It should be noted that fiberoptic controls may also be provided at the distal end 20 to permit control of the hydraulic mechanism and extension/retraction of the boom assembly 10 by an individual positioned in the bucket 22. Fiberoptics are preferably utilized to avoid the necessity of a dual hydraulic system.

As can be seen from the above, the present invention provides a light weight yet structurally sound boom assembly for use with utility vehicles and the like. The construction of the present invention permits extension of the boom assembly such that when the fly or outermost boom moves axially outwardly from the remainder of the boom portions, there are not steel connections to the fly boom section from beneath. The fly boom section, in particular the outer structural shell, and the control cylinder therefor is constructed of high dielectric material. This feature insulates the distal end of the fly boom, including the operator bucket and the individual positioned therein, from the ground. This is a significant safety feature when the boom assembly of the invention is being utilized around high power lines the like. This feature is heretofore unknown and not provided by any other type of existing boom assembly structure. It should also be noted that the sequence of extension and retraction of the boom sections provides for less stress and wear of the sliding members.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein but may be modified within the scope of the appended claims.

I claim:

1. A telescopic boom assembly comprising:

a plurality of boom members having at least first, second and third boom arms telescopically disposed within each other;

means for connecting said first boom arm to a support base;

means for axially extending said second and third boom arms outwardly from said first boom arm, said third boom arm being constructed from dielectric material and disposed at the distal end of said assembly when said assembly is in an extended position; and end cylinder means constructed from dielectric material and adapted for axially moving said third boom arm relative to said first and second boom arms such that said third boom arm and said end cylinder means dielectrically insulate the distal end of said third boom arm from the remainder of said boom assembly when said assembly is in an extended condition.

2. The boom assembly as claimed in claim 1, wherein said extending means includes said end cylinder means and comprises at least three cylindrically-shaped members each connected to one said boom arm to control axial movement thereof.

3. The boom assembly as claimed in claim 2, wherein said cylindrical-shaped members comprise a rod member connected to said first boom arm, a first cylindrical member surrounding said rod and connected to said second boom arm to comprise a mid boom, and a second cylindrical member surrounding said first cylindrical member and connected to said third boom arm to comprise a fly boom.

4. The boom assembly as claimed in claim 3, wherein said rod member is connected to said first boom arm to maintain the axial position thereof relative to movement to said second and third boom arms.

5. The boom assembly as claimed in claim 4, wherein said first cylindrical member is connected to said mid boom so as to axially extend both said mid and fly booms relative to said first boom arm until said mid boom is in its fully extended position.

6. The boom assembly as claimed in claim 5, wherein said second cylindrical member is connected to said fly boom so as to extend said fly boom to its fully extended position only after said mid boom is fully extended.

7. The boom assembly as claimed in claim 6, wherein said assembly further includes hydraulic means for controlling the axial movement of said first and second cylindrical members and said boom arms.

8. The boom assembly as claimed in claim 6, wherein said assembly further includes means for connecting an operator containment mechanism to the distal end of said fly boom, said operator containment mechanism being dielectrically insulated from the remainder of said boom assembly by said third boom arm and second cylindrical member.

9. The boom assembly as claimed in claim 1, wherein said support base includes a rotatable base member secureable to a vehicle and adapted to provide 360° rotation of said first boom arm relative to said vehicle.

10. The boom assembly as claimed in claim 1, wherein said extending means comprises a control cylinder mechanism adapted to extend a plurality of control arms interconnected with said boom arms such that said third boom arm and said end cylinder means provide high dielectric insulation for said boom assembly.

11. In an extendible boom assembly having a plurality of boom sections including a base boom section which is rotatably connected to means for providing pivotal motion in a vertical plane about a pivotal axis, a mid boom section slideably mounted to said base boom section for telescopic motion between a retracted position disposed within said base boom section and an extended position in which said mid boom section is extended axially outwardly from said base boom section, and a fly boom section slideably mounted to said mid boom section for telescopic motion between a retracted position disposed within said mid boom section and an extended position in which said fly boom section is extended axially outwardly from said mid boom section when said mid boom section is in its fully extended position relative to said base boom section, and further including an extension cylinder assembly connected to said base boom section to control the extension of said boom assembly, the improvement comprising:

a rod member connected to said base boom section proximate said pivotal motion means;

a first cylinder mounted about said rod for axial movement thereon and connected to said mid boom section to move said mid boom section between its retracted and extended positions; and a second cylinder mounted about said first cylinder for axial movement thereon and axial movement therewith relative to said rod, said second cylinder being connected to said fly boom section to move said fly boom section between its retracted and its extended positions, said fly boom section and said second cylinder being constructed from dielectric material such that said fly boom section and said second cylinder provide dielectric insulation for said boom assembly when in an extended position.

12. The improvement as claimed in claim 11, wherein said assembly further includes operator carrier means disposed at the distal end of said fly boom section and electrically insulated from the lower portions of said boom assembly by said fly boom section.

13. The improvement as claimed in claim 11, wherein said boom assembly further includes hydraulic means to control the axial movement of said cylinders and said boom sections.

14. The improvement as claimed in claim 13, wherein said hydraulic means includes hydraulic lines operating said first and second cylinders independently and sequentially to extend the same to their fully extended positions.

15. The improvement as claimed in claim 11, wherein said first cylinder serves as a rod relative to said second cylinder which surrounds said first cylinder.

16. The improvement as claimed in claim 15, wherein said mid and fly boom sections surround said first and second cylinders, and wherein said first and second cylinders each include head assemblies disposed at the lower ends thereof for interconnection to their respective boom sections.

17. The improvement as claimed in claim 16, wherein the head assembly of said first cylinder is disposed to move the head assembly of said second cylinder axially outwardly to move said fly boom with said mid boom when said mid boom is being moved to its fully extended position.

18. A utility vehicle comprising:

a frame;

a telescopic boom assembly having a lower portion thereof pivotally and elevationally mounted on said frame;

means interconnected between said frame and said boom assembly for extending and retracting said boom assembly;

said boom assembly including a plurality of boom members having at least first, second and third boom arms telescopically disposed within each other;

means for pivotally and elevationally connecting said first boom arm to said frame;

means for axially extending said second and third boom arm outwardly from said first boom arm, said third boom arm being constructed from dielectric material and disposed at the distal end of said assembly when said boom assembly is in a fully extended position; and end cylinder means constructed from dielectric material and adapted for axially moving said third boom arm relative to said first and second boom arms such that said third boom arm and said end cylinder means dielectrically insulate the distal end of said third boom arm from the remainder of said boom assembly and said frame when said boom assembly is in an extended assembly.

19. The utility vehicle as claimed in claim 18, wherein said vehicle further includes operator carrier means disposed at the distal end of said third boom member, said operator carrier means being dielectrically insulated from the frame of said vehicle to prevent grounding of said carrier means in the event of contact thereof with a high voltage source.

* * * * *